United States Patent [19]

Bavavéas

[11] Patent Number: 5,038,417

[45] Date of Patent: Aug. 13, 1991

[54] CONTAINER FOR DISTRIBUTING DOSES OF TREATMENT FLUID

[76] Inventor: Tristan Bavavéas, 56, avenue de Suffren F, 75015 Paris, France

[21] Appl. No.: 540,308

[22] Filed: Jun. 20, 1990

Related U.S. Application Data

[63] Continuation of Ser. No. 372,211, May 1, 1989, abandoned, which is a continuation of Ser. No. 115,944, Nov. 2, 1987, abandoned.

[30] Foreign Application Priority Data

Nov. 3, 1986 [FR] France ..... 86 15276
May 19, 1987 [FR] France ..... 87 06965

[51] Int. Cl.[5] ..... E03D 9/02
[52] U.S. Cl. ..... 4/228; 4/227
[58] Field of Search ..... 222/546

[56] References Cited

U.S. PATENT DOCUMENTS

| | | | |
|---|---|---|---|
| 2,065,181 | 12/1936 | French | 4/227 |
| 2,366,963 | 1/1945 | Goldbert | 222/500 |
| 2,986,310 | 5/1961 | Spaulding | 222/422 |
| 3,945,062 | 3/1976 | Corsette | 4/228 |
| 4,281,779 | 8/1981 | Shepard | 222/501 |

FOREIGN PATENT DOCUMENTS

| | | | |
|---|---|---|---|
| 914084 | 7/1949 | Fed. Rep. of Germany | 222/422 |
| 705904 | 3/1954 | United Kingdom | 4/228 |

*Primary Examiner*—Henry J. Recla
*Assistant Examiner*—David J. Walczak
*Attorney, Agent, or Firm*—Mason, Fenwick & Lawrence

[57] ABSTRACT

A container for distributing doses of a treatment fluid to a mass of water in a toilet tank which has a level which falls and rises upon slushing of the toilet tank comprises a fluid chamber at the top, a neck at the bottom, and a dosing device mounted in the neck. The fluid chamber contains the treatment fluid and a first mass of air above the treatment fluid, and has a single opening therein. The neck points downwardly into the toilet tank for alternate immersion and removal from the mass of water as the level of the mass of water rises and falls, is in fluid communication with the fluid chamber through the single opening in the chamber, and has a free edge. The dosing device has a first stage of operation when the level of the mass of water in the tank is rising and a second stage of operation when the level of the mass of water in the tank is falling, and comprises a transverse wall at a distance from the free edge of the neck means defining an air chamber and having an aperture therethrough, the aperture defining an evacuation hole means in the air chamber, a passage having an upper end which opens into the evacuation hole and a lower end having an opening defining a discharge hole, and gravity-operated, movable, mechanical regulating device positioned in the passage for regulating the doses distributed as the fluid chamber is emptied, the regulating device supporting a column of the treatment fluid.

6 Claims, 3 Drawing Sheets

CONTAINER FOR DISTRIBUTING DOSES OF TREATMENT FLUID

This application is a continuation of U.S. patent application Ser. No. 97/372,211, filed May 1, 1989, which is a continuation of U.S. patent application Ser. No. 115,944, filed Nov. 2, 1987 both now abandoned.

The invention concerns a container for distributing doses of treatment fluid.

BACKGROUND OF THE INVENTION

There are numerous embodiments for containers for distributing doses of treatment fluid, comprising a dosing device mounted in the neck of the container, the container being intended to function with the neck pointed towards the bottom, alternatively immersed in and taken out of a mass of water, in particular a toilet tank.

In the first embodiment, which has numerous variations, the dosing device comprises a float suspended under the neck of the container, fixed to one or two mobile valves operating together with one or two fixed seats accommodated in the neck of the container (patents: French 2 572 749, European 182 671, U.S. Pat. Nos. 4,346,483, 4,285,074, 3,778,850, 3,774,808, 3,698,021, 2,722,394, 2,967,310, 3.908,209, 3,841,524, 4,189,793, 4,131,958, 2,726,406, 4,036,407, 4,066,187, 3,965,497). This first embodiment is based on the principle that the variation of the water level in the water tank causes ascending or descending vertical slide of the float which itself causes the opening and closing of the valve or valves, which are of a mechanical or air type. According to certain variations, the valves, the seats and the neck of the container are put together to create the dosage chambers, with the aim of issuing defined doses of treatment fluid. Containers with dosing devices according to this first embodiment have the disadvantages that their functioning is linked to the movement of the float with all resulting imprecisions; that the halting of the flow is very random; that the mechanical-type closures are rather weak; and finally numerous pieces are required.

In a second embodiment, a discharge hole is accommodated in a transverse wall distanced from the free edge of the neck accomodating an air chamber. The container is only partially filled with the maintenance fluid. This second embodiment is based on the principle that the rise in the water level in the water tank above the free edge of the neck traps a mass of air in the air chamber. Then, when the level continues to rise, this mass of air is compressed and, when there is sufficient excess pressure, partially ejected into the container above the treatment fluid or it causes a certain excess pressure in relation to the external atmosphere. When the level of water in the water flush goes down to below the free edge of the neck, the excess pressure which exists in the air chamber disappears, as a result of its contact with the external atmosphere. The excess pressure existing in the container causes the expulsion of the treatment fluid until there is an equilibrium of pressure again on both sides of the discharge hole. This second embodiment is described in U.S. Pat. Nos. 3,806,965, 3,787,904, 3,864,763, 2,688,754, 3,073,488 and English patents 710 796, 2 094 846. This second embodiment has two advantages over the previously described first embodiment. On one hand, a "hydraulic" function resulting from the single variation of pressure in the time following the filling and emptying of the water tank and the resulting difference in pressure between one side of the discharge hole and the other, this functioning being theoretically continuous in contrast to the "mechanical" functioning operating the drive of a float commanding one or more valves which eventually jam causing functioning to be forcably discontinued. Meanwhile, the forms of execution of this second embodiment have the disadvantage that, from the functioning principle, the quantity of maintenance fluid issued is not invariable in the period, as soon as the container is emptied itself. In effect, as soon as the container is emptied, on one hand, the hydrostatic pressure exerted by the maintenance fluid on the discharge hole reduces and, on the other hand, the volume of air in the container which must have excess pressure to evacuate the maintenance fluid, increases.

SUMMARY OF THE INVENTION

The invention comprises a container for distributing doses of treatment fluid, to issue invariable doses of maintenance fluid, whatever the superficial tension of the fluid of the liquid which one wishes to distribute.

The invention therefore proposes, firstly and in the first variation, a container for distributing doses of treatment fluid comprising a dosing device mounted in the neck, the container being intended to function with the neck of the container, pointed towards the bottom, alternatively immersed in and taken out of a mass of water, in particular a toilet water tank, the dosing device being of a type essentially comprising a transverse wall extending from the free edge of the neck and so creating a chamber of air and a hole for evacuating treatment liquid punched in the wall, the dosing device functioning in a first phase by the creation of excess air pressure in the container when the water level rises above the level of the neck, as a result of the formation in the chamber of a mass of air separated from the atmosphere by the mass of water, then its compression and finally expulsion into the container via the evacuation hole, and in a second phase, at the lowering of the water level below the level of the neck by evacuating part of the treatment liquid via the evacuation hall which is ejected on the exterior of the container following the excess pressure created previously in this, as a result of connecting the air chamber with the atmosphere, until the pressure in the container returns to a value corresponding to that the of the atmospheric air thus causing a halt in the flow of treatment fluid, characterised in that the dosing device comprises a mechanical, adjusting mechanism which functions essentially by gravity, with functions, on one hand, to reduce the opening of a passage leading to a discharge hole at the second phase of the lowering of the water level and discharge of treatment fluid and, on the other hand, to reduce the variation related to the total weight of the adjusting mechanism and the treatment fluid column which it supports, given the approriate weight of the adjusting mechanism, this adjusting mechanism being intended for regulation of doses distributed as soon as the container is empty.

The invention proposes a container for distributing doses of treatment fluid comprising a dosing device mounted in the neck characterised in that it comprises an adjusting mechanism comprising a mounted mobile piece with a passage into a skirt attached to the tranverse wall, placed in the air chamber, terminated at the side of the free edge of the neck, normally lower, by the discharge hole and on the opposite side, that is towards the container, normally higher, by the evacuation hole.

The invention proposes finally and in a second variation a container to distribute doses of treatment fluid comprising a dosing device mounted in the neck, the dosing device being of the type comprising an upper transverse wall extending from the lower free edge of the neck of the container, creating a chamber of air and punched in the hole for evacuating the treatment fluid; a fixed lower transverse return extending from the lower free edge of the neck and punched in the treatment fluid discharge hole at an axial distance from the evacuation hole; a fixed lateral skirt connecting the transverse wall and the lower return; a passage for the treatment fluid between the evacuation hole and the discharge hole, along the skirt; and a part forming an axially movable valve needle cooperating with the discharge hole, characterised in that the part forming the valve needle, belonging to a device essentially situated between the transverse wall and the lower return, is mobile between the extreme lower position at which it corresponds with the lower tranverse return forming a seat to close the discharge hole and an upper position at which it is distanced from the lower return to open the discharge hole at least partially; and on which a vertical descending force is exerted which is, on one hand, greater than the maximum force exerted by the treatment liquid on the evacuation hole and, on the other hand, less than the force exerted on the discharge hole as a result of there being water in the full water tank via the chamber of air; in such a way that, in the first place, when the tank is full, the part forming the valve needle may be in the extreme lower position as a result of the force which is exerted on it; in the second place, when the water tank is empty, this part forming the valve needle first passes from its extreme lower position to a higher position as a result of this force being less than the force exerted in the opposite direction by the excess air pressure in the container above the treatment fluid and by the treatment fluid itself, until a dose of treatment fluid flows through the discharge hole and this part forming the valve needle then passes from this upper position to the extreme lower position when the force exerted in the opposite direction to the force which is exerted on this valve needle forming part is less than this latter force; and, in the third place, when the tank fills, this valve needle forming part first passes from its extreme lower position to this higher position as a result of the force exerted by the water in the tank being greater to that exerted in the opposite direction by the treatment fluid, which causes the transfer of air from the air chamber to the inside of the container above the treatment fluid via the discharge hole, the passage and the evacuation hole thus creating said excess air pressure and this valve needle forming part then being passed from this upper position to its extreme lower position as a result of the force which is exerted on said valve needle forming part, when the excesses in air pressure within the container above the treatment fluid and within the air chamber are substantially the same.

Other characterstics and advantages of the invention will be shown in the following description which refers to appended drawings.

DESCRIPTION OF THE PREFERRED EMBODIMENTS

Figure 1:
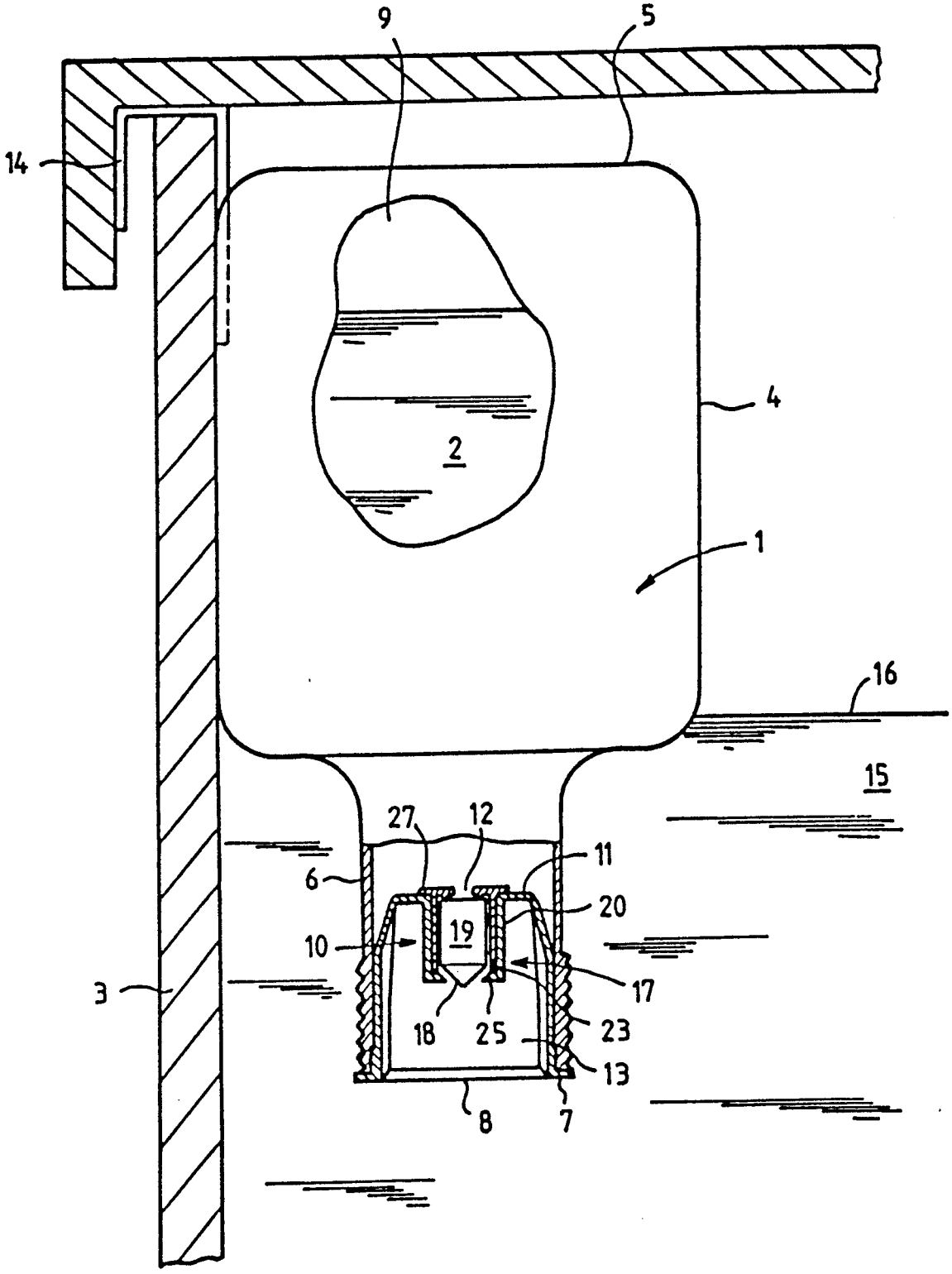
FIG. 1 is a schematic view showing the method of assembly of a container according to the first variation of the invention in a toilet water tank, both the container and the tank being filled.
Figure 2A:
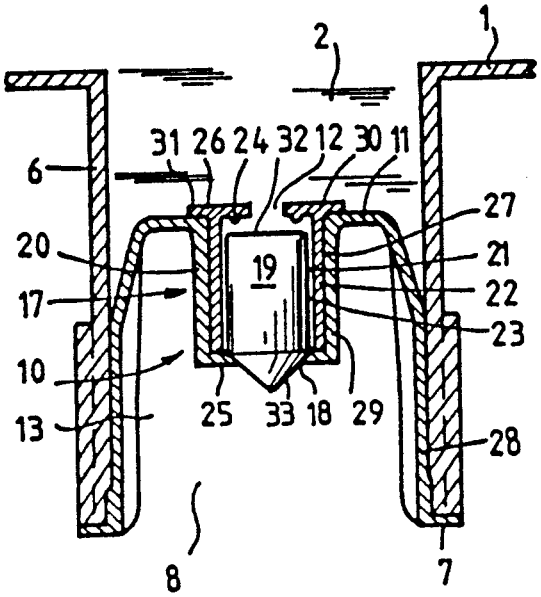
FIG. 2A and 2B are two partial schematic views, on a larger scale, of the first possible embodiment of the first variation of the invention in two different functioning states, empty and full tank, respectively.
Figure 2B:
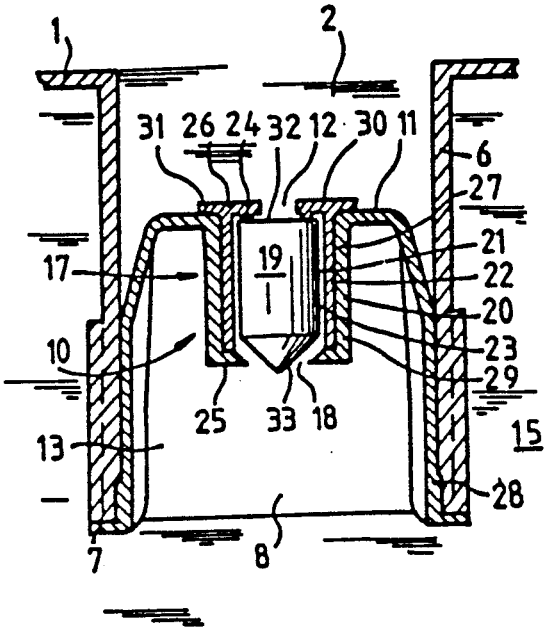
Figure 3:
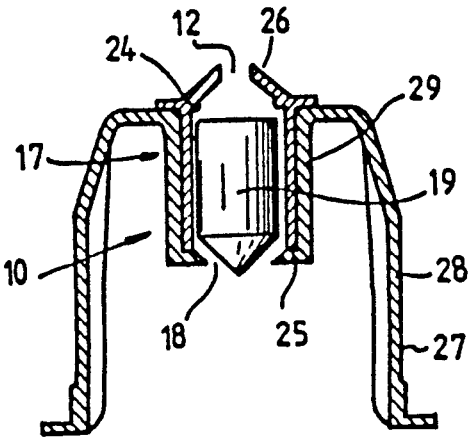
FIGS. 3 and 4 are two partial schematic views, on a larger scale, of second and third possible embodiments of the first variation.
Figure 4:
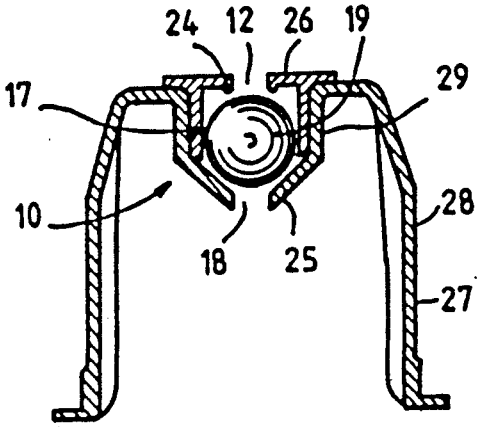

The invention concerns a container 1 for distributing doses of a treatment fluid 2, principally for a toilet water tank 3.

The fluid 2 is for colouring, perfuming, disinfecting, or other. The qualification "treatment" therefore covers all desired functions, this fluid generally contains surface-active products and, for this reason, has a superficial tension very clearly greater than that of water.

The container 1 comprises a lateral wall 4, a base 5 and a neck 6 bordered by a free edge 7 defining an opening 8.

The container 1 can have a general, normally vertical axis 1*a*. It can be cylindrical or, preferably flattened with a transverse cross-section more or less pseudo-rectangular. The container 1 is rigid so as not to be substantially distorted by depression or excess pressure inside.

Initially the treatment fluid 2 fills the container 1 only partially, for example to $\frac{2}{3}$ of its volume, so as to leave the amount of air 9 necessary to the functioning inside.

The container 1 can have for example a height of approximately 15 cm and a total volume of approximately 300 $cm^3$.

Before use, for storage and transportation, a cork (not shown) is screwed, ratched or otherwise onto the neck 6 to close the opening 8. In this situation, the container 1 generally rests on its base 5, the neck 6 being pointed towards the top.

The container 1 comprises a dosing device 10 mounted in the neck 6, of a type essentially comprising a transverse wall 11 placed in the neck 6 at a distance from the free edge 7; a hole 12 for evacuating 12 the treatment fluid punched in the wall 11, specifically axially (first variation) or laterally (second variation); and a chamber of air 13 bordered by the wall 11 and the part of the neck 6 between the wall 11 and the free edge 7.

When functioning, the container 1, with the cork taken out and the neck 6 pointing towards the bottom, is placed vertically in the water tank 3. A hook 14, which is telescopic and can equally comprise a mechanism adjusting the position of the container in the water tank 3 to regulate the height in relation to the water in which the container 1 is placed, or more generally any other similar maintenance device allowing the container 1 to be fixed in the water tank 3 so that it can be removed, in this position in such a way that the neck 6 can respectively be immersed in or taken out of the mass of water 15 in the tank 3 when it is full or empty. Consequently, the neck 6 is alternatively immersed and taken out when the water tank operated. The water level 16 in the mass of water 15 of the full water tank 3 extends to the height of the evacuation hole 12 at a distance sufficient to create the excess air pressure necessary to the functioning of the dosing device 10. This distance is approximately a few centimetres. For example, the water level 16 in the full water tank 3 is a little above the neck 6.

The dosing device 10 functions as follows.

When the water tank 3 fills with water, after being operated, the water level 16 rises to reach the free edge 7. At this moment, a mass of air is trapped in the air chamber 13. The level 16 continues to rise to the maximum level relating to the full water tank. This rise in the level 16 causes excess air pressure in the chamber 13 in relation to the existing pressure within the container 1. When there is sufficient excess air pressure, the air in the chamber 13 is expelled into the container 1 via the evacuation hole 12 and across the treatment fluid 2 up to the mass of air 9 then under the base 5, until a new pressure equilibrium is established on each side of the evacuation hole 12. In this first phase, an excess in air pressure is thus created in the container 1.

In this equilibrium situation the full water tank 3, the treatment fluid 2 cannot flow through the evacuation hole 12, takes account of the pressures on each side of the hole 12 and the dimensions of the hole 12.

When the tank 3 is operated, the mass of water 15 which it contains is evacuated and the level 16 goes down. When the level 16 reaches the free edge 7, the chamber of air 13 connects up with the external atmosphere and the excess of pressure which previously existed in this chamber 13 disappears. The result of this is that the pressure above the evacuation hole 12, where the treatment fluid 2 is found is greater than that which exists below said hole 12, in the chamber 13, as a result of the excess pressure previously created. This difference in pressure on each side of wall 11 causes partial evacuation of the treatment fluid 2 via the evacuation hole 12 (second phase). This flow of treatment fluid 2 stops when the relevant pressures considering the superficial tension of the treatment fluid 2 and the hydrostatic pressure are at equilibrium.

The dosing device 10 according to the invention comprises, according to a first variation and a first aspect of the invention (FIGS. 1 to 4), an adjusting mechanism 17*a*, mechanical, mobile, essentially functioning by gravity, and having as functions, on one hand, reduction of the opening of the passage leading to a discharge hole 18 at the second phase of the lowering of the water level 16 and discharge of fluid in such a way as to vary the point of equilibrium between the atmospheric pressure once the water receded and the pressure within the container 1 relating to the same equilibrium which would be obtained without mechanical adjustment and through a hole of invariable dimensions and, on the other hand, reduction of the variation relating to the total weight of the adjusting mechanism 17*a* and the column of treatment fluid 2 which it supports, given the appropriate weight of the adjusting mechanism 17*a*, this adjusting mechanism 17*a* being to regulate the doses distributed as soon as the container 1 is emptied.

As shown in FIGS. 1 to 4, the dosing device 10 according to the invention comprises, according to this same first variation and a second aspect of the invention, an adjusting mechanism 17*a* comprising a mobile piece 19 mounted with a passage 23 in a skirt 20 attached to the transverse wall 11, placed in the chamber of air 13, terminated at the side of the free edge 7 of the neck 6, specifically lower, by a discharge hole 18 and on the opposite side, that is towards the container 1, specifically higher, by the evacuation hole 12.

The mobile piece 19 comprises a lateral wall 21 extending from the lateral wall 22 from the skirt 20 to create a calibrated passage between them for the treatment fluid 2.

There are projections 24 or the like close to the evacuation hole 12, in such a way that the evacuation hole 17 remains permanently open, whatever the position of the mobile piece 19, particularly in the extreme high position.

The skirt 20 comprises a lower return 25 in which is embodied the discharge hole 18 in which the mobile piece 19 flows freely without sealing the discharge hole 18.

The return 25 is preferably conical, truncated, pyramidal or in the shape of the body of a pyramid, the point of which points towards the bottom, that is towards the free edge 7 the large base of which is pointing towards the top, that is towards the transverse wall ll.

It is understood that in all descriptions, the qualifications "top", "bottom", "higher" or "upper", "lower" refer to the container in the functioning position, the neck 6 pointing towards the bottom.

The skirt 20 comprises an upper return 26 in which the evacuation hole 12 is embodied.

The passage 23 between the mobile piece 19 and the skirt 20 and the discharge hole 18 have the same dimensions, according to the superficial tension of the maintenance fluid 2 to determine the flow-rate of the maintenance liquid 2. The evacuation hole 12 has sufficient dimensions to supply the passage 23 between the mobile piece 19 and the skirt 20. The passage 23 therefore has dimensions which allow evacuation of a precise dose of treatment fluid 2 and finally halt of evacuation.

The course of axial displacement of the mobile piece 19 is approximately the same size as the discharge hole 18.

In particular, the dimensions of the open discharge hole 18 depends on the superficial tension of the fluid which should be distributed as the desired flow-rate.

The size of the passage between the discharge hole 18 and the lower extremity of the mobile piece 19 is approximately the same or slightly greater than the dimensions of passage 23 between the mobile piece 19 and the skirt 20.

The weight of the mobile piece 19 is clearly larger than the weight of the column of treatment fluid 2 on the evacuation hole 12. For example, the mobile piece has a weight of approximately three to five times that of the column of treatment fluid 2 on the evacuation hole 12. This arrangement is such that the total weight of the mobile piece 19 and the column of treatment fluid 2 varies, in a relative manner, clearly less than if there had not been a mobile piece 19 of this weight. The result of this is an adjustment of the dosage of treatment fluid 2 issued.

As a result of the above, the mobile piece 19 does not comprise, properly speaking, a valve for hermetically sealing the discharge hole 18. Apart from the above-mentioned function of "tare" or countering added to the weight of the column of treatment fluid 2 on the evacuation hole 12, the mobile piece 19 has the function of considerably limiting the passage 23 between the mobile piece 19 and the skirt 20 to a suitable minimum value to halt the flow of treatment fluid 2 thus setting the point of equilibrium of the container 1 pressure and that of the atmospheric air to a higher level than normal without the existence of this mobile piece 19 does not exist in order to adjust the doses of treatment fluid 2 issued.

As a result of these two different but complementary functions, the mobile piece 19 has an adjusting effect on the doses of fluid issued, these being relatively invariable from one end of the container 1 to the other. These doses are, for example, from 0.125 ml to 0.250 ml of product which, for a container such as the above-mentioned, corresponds in normal use to a functioning duration of between approximately two and four months.

The mobile piece 19 can take two extreme positions, an extreme upper position and an extreme lower position. In the extreme upper position the mobile piece 19 is closest to the evacuation hole 12 and the two holes 12 and 18 are open. This position exists when, during the first functioning phase, the air in chamber 13 is compressed. In the extreme lower position, the extreme low part of the mobile piece 19 is inside the discharge hole 18 without necessarily blocking it and its cone-shaped walls rest on the equivalent walls of the lower return 25, the passage 23, at the contact points being reduced to a value so weak that, taking account of pressures in play and the superficial tension of the treatment fluid 2, the flow could be halted before the interior pressure of the container 1 has recovered the initial value. The container 1 therefore always remains in a slight excess pressure. This extreme low position is at the end of the second functioning phase.

Preferably the evacuation hole 12 is situated at the same level or in the immediate vicinity, specifically slightly above, the wall 11. Morover, the skirt 20 and the return 25 are situated entirely or almost entirely in the chamber 13.

For example, on one hand, the axial height H of the skirt 20 can be approximately the distance E between the wall 11 and the free edge 7 and equally, on the other hand, the diameter d of the skirt 20 can be approximately half diameter D of the chamber 13. Finally, the extent E can be the same size as the diameter D or slightly larger. Excellent results have been obtained with the above-mentioned container with H, E, d, D respectively in the vicinity of 1.5cm, 3cm, 1.25 cm, 2.75cm.

Preferably, the wall 11 is a plane annular panel of a fixed support piece 27 mounted in the neck 6 and comprising an external cylindrical part 28 (of diameter D) accommodated, particularly at force, in the neck 6 and an internal cylindrical part 29 comprising the external wall of the skirt 20. The lower return 25 is preferably formed by the fixed support piece 27.

Another piece 30 mounted at force within the support piece 27 comprises the internal wall of the skirt 20 and the upper return 26. This piece 30 is mounted after insertion within the skirt 20 and between the returns 25, 26 and the mobile piece 19.

The piece 30 can comprise an external annular projection 31 supported on wall 11 to axially block and correctly put in position the piece 30 on the support piece 27.

According to a first embodiment, the upper return 26 is approximately plane (outside the projections 24) and pependicular to the axis of the container 1. According to a second embodiment, the upper return 26 generally has a conical or pyramidal shape the point of which is directed towards the base 5 and the large base towards the mobile piece 19.

According to another embodiment, the mobile piece 19 has in axial cross-section a form bordered by a lateral wall 21, a transverse wall of upper extremity 32 specifically perpendicular to the axis of the container 1 and a lower wall 33, specifically in the form of a cone with the point directed towards the bottom. In transverse cross-section, the piece 19 is circular. According to a second embodiment, the mobile piece 19 is spherical.

These two above-mentioned embodiments can be combined.

As has resulted from the above, the weight of the mobile piece 19 serves to control the excess pressure created within the container 1 after its immersion in such a way as to act on the volume of the dose evacuated after each functioning of the flush 3.

The mobile piece 19, each time the doser is taken out, permits only one dose of treatment fluid 2 to be evacuated corresponding to only one part of the quantity of air introduced into the container 1 when the doser is immersed.

The dosing device 10, according to the invention, is such, according to the second variation and a first aspect of the invention (FIGS. 5 and 6) that a valve-needle forming part **17*b* belonging to a device 34 situated essentially between the upper transverse wall 11 and the lower return 25; is mobile between an extreme low position (as shown) in which it operates with the lower return 25, forming a seat to close the discharge hole 18 and an upper position (not shown) in which it is extended from the lower 25 to open the discharge hole 18 at least partially; and on which a descending vertical force is exerted which is, on one hand, greater than the maximum force exerted by the treatment fluid 2 on the evacuation hole 12 and, on the other hand, less than the force exerted on the discharge hole 18 as a result of water being in the full flush via the air chamber 13. In such a way, in the first place, when the tank 3 is full, the valve needle forming part 17*b* can be in the extreme lower position as a result of the force which is exerted on it. In the second place, when the tank 3 is emptied, this valve-needle forming part 17*b* first passes from the extreme lower position to a higher position as a result of this force being inferior to the force exerted in the opposite direction by the excess of air pressure in the container 1 above the treatment fluid 2 and the treatment fluid 2 itself until the flow of a dose of treatment fluid 2 though the discharge hole 18 and that this valve-needle forming part 17*b* passes then from the upper position to the extreme lower position whenn the force exerted in the opposite direction to the force which is exerted on this valve needle forming part is less than the latter force. In the third place, when the tank 3 fills, this valve needle forming part 17*b* passes first from its extreme lower position to this upper position as a result of the force exerted by the water in the tank 3 being greater than that exerted in the opposite direction by the treatment fluid 2 via the discharge hole 18, the passage 23 and the evacuation hole 12 participating thus in creating the said excess air pressure. This valve needle forming part 17*b* can then be passed from this upper position to its extreme lower position, as a result of the force exerted on said valve needle forming part 17*b* when the excess air pressure within the container 1 above the treatment fluid 2 and inside the air chamber 13** are substantially the same.

The dosing device 10, according to the invention is such, according to this same second variation, a second aspect of the invention and a first possible embodiment, (FIG. 5) that the valve needle forming part **17*b* forms a monobloc assembly, with the device 34 which is rigid and nondeformable accommodated at the axial slide in a fixed casing 35 comprising a transverse partition at the upper extremity 36 and a lateral partition 37 terminated by a lower opening 38. In this first variation, said force exerted on the valve needle forming part 17***b*, in this case the mobile device 34, is its own weight.

In addition, these two aspects of the invention in this second variation combine together.

Figure 5:
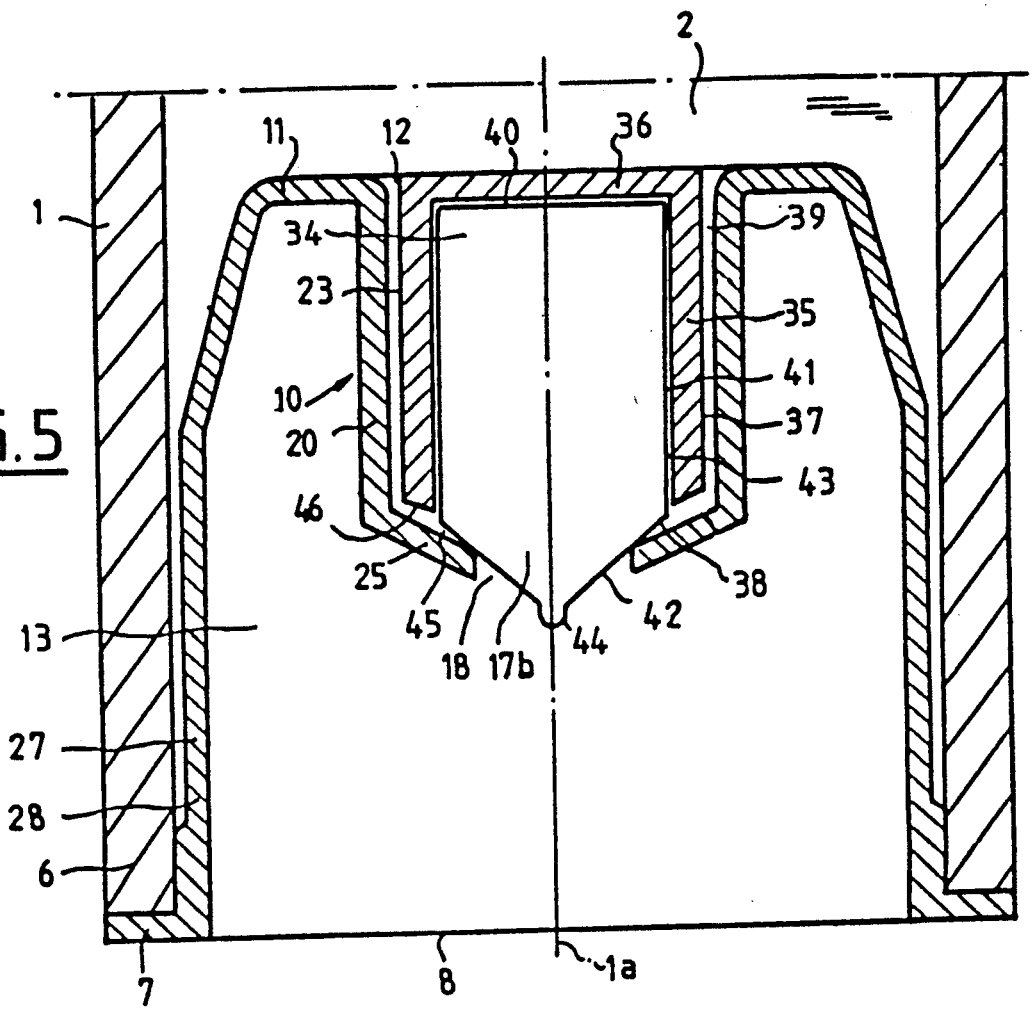
FIGS. 5 and 6 are two sectional schematic views through an axial plane of the dosing device according to the second variation of the invention which is partially shown (the water tank not being shown) and according to two embodiments.
Figure 6:
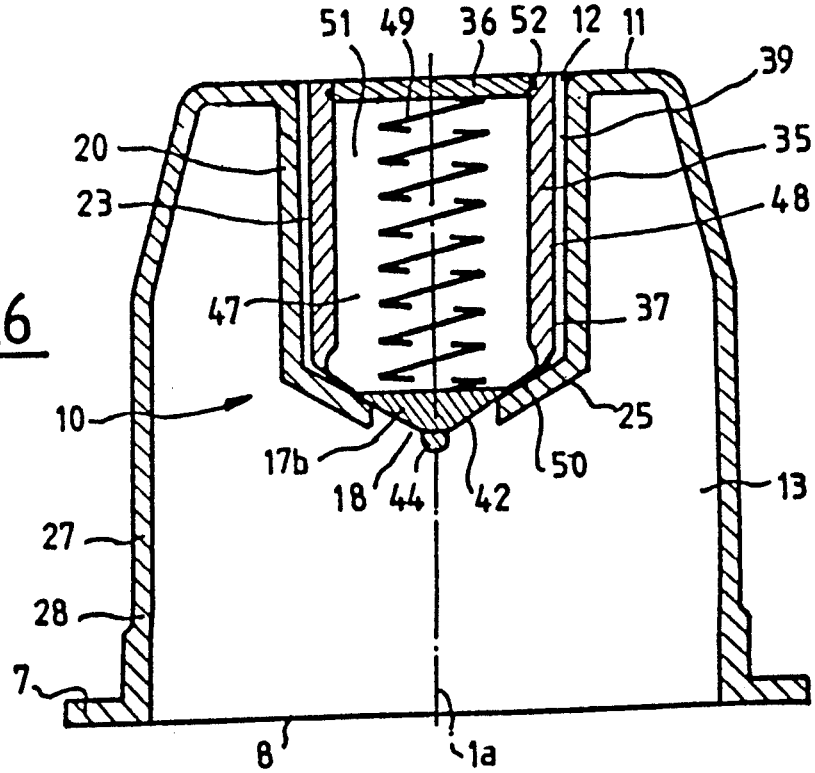

The structure of the dosing device as referred to it FIG. 5, is now described in greater detail.

The passage 23 of treatment fluid is created, on one hand, by the radial distance existing between the skirt 20 and the lateral partition 37 and, on the other hand, by the axial distance existing between the lower return 25 and the lateral partition 37 the radial distance being connected to the axial distance.

The casing 35 comprises projections 39 attached to the lateral partition 37 and pointed towards the exterior, the function of which is, on the one hand, to keep in place, driven in with force, casing 35 in the skirt 20 and, on the other hand, to accommodate between the lateral partition 37 and the skirt 20 the distance, both radial and axial, comprising the passage 23 of the treatment fluid. For example, the projections 39 are at least three in number, particularly four or more, regularly divided around the axis 12 of the dosing device and have an axially elongated form, particularly extending along the entire axial height of the lateral partition 37.

The transverse partition at the upper extremity 36 and the upper transverse wall 11 are at least approximately coplanar and plane, the evacuation hole 12 being accommodated between them. The evacuation hole 12 is therefore generally ring-shaped.

The lower opening 38 and the discharge hole 18 are situated opposite and in close proximity to each other, the diameter of the lower opening 38 being larger (clearly larger than that of the discharge hole 18).

Otherwise, the area of the discharge hole 18 is clearly larger than the area of the evacuation hole 12. For example, the area of the discharge hole 18 is between around 2 and 3 times the area of the evacuation hole 12.

The return 25 is truncated with its point directed towards the bottom, the angle of the opening of which is between 107 degrees and 146 degrees approximately, more particularly between 114 degrees and 140 degrees approximately, specifically equal or close to 127 degrees.

The mobile device 34 is bordered by an upper transverse face 40, a lateral face 41 and a lower transverse face 42, the lateral face 41 operating with the lateral partition 37 with radial play 43 in such a way as to allow at the same time axial control and the axial slide of the mobile device 34.

The mobile device 34 projects, by its lower transverse face 42, from the opening 38 of the casing 35.

The lower transverse face 25 has, at least approximately, a conical form, the point of which 44 projects below the discharge hole 18.

The opening angle of the lower transverse face 42 is between 81 degrees and 111 degrees approximately, specifically it is equal or approximately 96 degrees.

The lower transverse face 42 forms at its extremity a bulging point 44.

At the extreme lower position, the mobile device 34 rests on the lower return 25, specifically at the edge of the discharge hole 18. In this position the real and artificial points respectively of the mobile device 34 and the lower return 25, conical and truncated, are joined or close together, the angle of the opening of the lower return 25 being larger than that of the lower transverse face 42 in such as way as to ensure, on one hand good contact with the mobile device 34 on the edge of the discharge hole 18 and, on the other hand, the existence close to the lateral face 41 of a play 45 between the lower transverse face 42 and the lower return 25 connecting up to the passage 23 by the said axial distance, which allows the treatment fluid 2 to act on the mobile device in the direction it is raised.

Preferably, the extreme lower edge 46 of the lateral partition 37 around the opening 38 is bevelled in such a way as to be approximately parallel to the lower return 25.

In the extreme upper position, the device 34, particularly its lower transverse face 42 is distanced from the lower return 25, in particular at the edge of the discharge hole 18 at a distance equal to or on the order of the axial distance between the lower return 25 and the lateral partition 37, more precisely its edge 46.

The slide course of the mobile device 34 is weak but necessary and sufficient to ensure optimum functioning of the dosing device 10.

The mobile device 34 and/or the casing 35 is of a rigid material, specifically polyacetal or equivalent.

Preferably, the return 25, the upper transverse wall 11 and the skirt 20 are monobloc and form part of a piece 27 comprising equally an external cylindrical part 28.

The piece 27 is of a material with a certain suppleness to facilitate impermeability with the container neck and/or the mobile device 34. with a lower part 42 comprising the valve needle forming part 17*b* which is conical or pseudoconical. It is mounted in a sliding manner with weak play and weak course in the casing 35 which, in an axial section, generally takes the form of an inverted U in such a way that the lower conical or pseudoconical part 42 projects from the opening 38 of the U-shape. The casing 35 is itself fixedly mounted, as a result of the projections 39, in the skirt 20 to form a vent. The piece 27 has a general double U form, that is a large inverted U defined in relation to the core of the upper transverse wall 11 and in relation to wings through the external cylindrical part 28, is concerned, and a small U placed in the large U defined in relation to the core, punched, by the lower return 25 and the wings through the skirt 20 linked to the core of the large U.

The weight of the mobile device 34 is for example on one hand, slightly greater than the maximum force exerted by the treatment fluid 2 on the evacuation hole 12 and/or, on the other hand, clearly smaller than the maximum force exerted by the flush water on the discharge hole 18 via the air chamber 13.

The dosing device 10 according to the invention is such, according to another aspect of the invention of this same second variation and the second preferable embodiment (FIG. 6), that the valve needle forming part 17*b* comprises the extreme lower part of a monobloc device 47, the extreme upper part 48 of which is fixed and has a general shape closely ressembling that of the above-mentioned fixed casing 35, with the notable exception of the lower opening 38 absent in this embodiment.

In addition, a flexibly ductile device 49 acts on the valve needle forming part 17*b* to produce on this part 17*b* the necessary force, as described above. In contrast to the first embodiment where said force results from the weight of the heavy mobile device 34, said force is, in this second embodiment essentially or substantially the result of an externally applied force.

In one possible embodiment the device 47 comprises an intermediary connecting part 50 between the valve needle forming part 17*b* and the extreme upper part 48, this intermediary connecting part 50 being ductile, in such a way that a relative axial displacement is possible between the parts 17*b* and 48, if there is axial displacement of part 17*b*, part 48 being immobilised. This ductility of the intermdiary part 50 can take various suitable forms, in particular weakening of the density of device 47.

The device 47 is, in one possible embodiment, a recess which creating a hermetically sealed central cavity 51 which is hermeically sealed in which the device 49 is accommodated.

The device 49 is for example a helical spring acting in such a way as to exert a force in the direction of an expansion.

The device 47 is, in one possible embodiment, such that the transverse partition of the upper extremity 36 is movable but can be hermetically sealed on the extreme upper part 48 of the device 47, for example by means of projections and recesses 52.

In the said embodiment, only the intermediary connecting part 50 is ductile, the valve needle forming part 17*b* being dimensionally stable, in particular sufficiently thick to form within the cavity 51 a seat for the spring 49.

In this embodiment, the angle of the opening of the lower transverse face 42 is equal to or approximately 120 degrees.

The dosing device according to the invention allows distribution of invariable or almost invariable doses of treatment fluid. These doses can be varied, for example, by 0.10ml to 0.25ml each. The container 1 can distribute 500 doses or more. The physical parameters of a dosing device (in particular dimensions, weight, force etc) are determined by the specialist according to the desired dose.

Whatever the variation in embodiment, the surface area of the evacuation hole 12 is equal to or slightly greater than that of the discharge hole. In addition, the course of the device 17, 19 depends on the function of the surface area of the flow in the passage 23 so that the opening of the discharge hole is not larger than the surface area of the flow within the passage 23.

I claim:

1. A container for distributing doses of a treatment fluid to a mass of water in a toilet tank, the mass of water having a level which falls and rises upon flushing of the toilet tank, comprising:

a top and a bottom;

fluid chamber means at said top for containing the treatment fluid and a first mass of air above the treatment fluid, said fluid chamber means having a single opening therein;

neck means at said bottom for pointing downwardly into the toilet tank for alternate immersion and removal from the mass of water as the level of the mass of water rises and falls, said neck means being in fluid communication with said fluid chamber means through said single opening and having a free edge;

a dosing device mounted in said neck means and having a first stage of operation actuated when the level of the mass of water in the tank is rising and a second stage of operation actuated when the level of the mass of water in the tank is falling, said dosing device comprising:

a transverse wall at a distance from said free edge of said neck means, a side wall connecting said transverse wall and said free edge and defining air chamber means for trapping a second mass of air therein when the mass of water rises above said free edge during said first stage of operation, the second mass of air being separated from the atmosphere by the mass of water, and said transverse wall having an aperture therethrough, said aperture defining an evacuation hole means in said air chamber means for expelling the second mass of air in said air chamber into said fluid chamber means during said first stage of operation and for partial evacuation of the treatment fluid from said fluid chamber means during said second stage of operation;

a skirt extending downwardly from said transverse wall into said air chamber means, said skirt defining a passage having an upper end and a lower end, said upper end opening into said evacuation hole means and said lower end having an opening defining a discharge hole; and an axially movable piece mounted in said skirt and cooperating with said discharge hole, said piece adapted to disengage from said discharge hole during said first stage to permit said second mass of air to be expelled from said air chamber into said fluid chamber and during said second stage of operation when said mass of water lowers below said free edge, thereby distributing a dose of treatment fluid into said mass of water.

2. A container for distributing doses of a treatment fluid to a mass of water in a toilet tank, the mass of water having a level which falls and rises upon flushing of the toilet tank, comprising:

a top and a bottom;

fluid chamber means at said top for containing the treatment fluid and a first mass of air above the treatment fluid, said fluid chamber means having a single opening therein;

neck means at said bottom for pointing downwardly into the toilet tank for alternate immersion and removal from the mass of water as the level of the mass of water rises and falls, said neck means being in fluid communication with said fluid chamber means through said single opening and having a free edge; and a dosing device mounted in said neck means and having a first stage of operation when the level of the mass of water in the tank is rising and a second stage of operation when the level of the mass of water in the tank is falling, said dosing device comprising:

an upper transverse wall at a distance from said free edge of said neck means, said transverse wall defining air chamber means for trapping a second mass of air when the level of the mass of water rises above said neck means during said first stage of operation, the second mass of air being separated from the atmosphere by the mass of water, and said transverse wall having an aperture therethrough, said aperture defining evacuation hole means in said air chamber means for expelling the second mass of air in said air chamber into said fluid chamber means during said first stage of operation and for partial evacuation of the treatment fluid from said fluid chamber means during said second stage of operation, said treatment fluid exerting a force on said evacuation hole means;

a lower return at a distance from said free edge of said neck means, said lower return defining a valve seat and having an opening defining a discharge hole means for discharging the treatment fluid, said discharge hole means being axially spaced from said evacuation hole means;

a skirt connected to said upper transverse wall and said lower return;

passage means along said skirt for conducting the treatment fluid between said evacuation hole means and said discharge hole means;

a device positioned between said upper transverse wall and said lower return, said device including axially movable valve needle means movable between an upper position distanced from said lower return when the tank is full and an extreme lower position when the tank is emptied for cooperating with said lower return for closing said discharge hole means in said extreme lower position and for at least partially opening said discharge hole means in said upper position for releasing a dose of the treatment fluid through said discharge hole means; and force-applying means for exerting on said valve needle means a descending vertical force which is greater than the maximum force exerted by the treatment fluid on said evacuation hole means and less than the force exerted on said discharge hole means through said air chamber means resulting from the mass of water in the full tank.

3. The container of claim 2, said force-applying means comprising the weight of said valve needle means.

4. The container of claim 3, said force-applying means comprising a flexibly ductile device.

5. A container for distributing doses of a treatment fluid to a mass of water in a toilet tank, the mass of water having a level which falls and rises upon flushing of the toilet tank, comprising:

a top and a bottom;

fluid chamber means at said top for containing the treatment fluid and a mass of air above the treatment fluid, said fluid chamber means having a single opening therein;

neck means at said bottom for pointing downwardly into the toilet tank for alternate immersion and removal from the mass of water as the level of the mass of water rises and falls, said neck means being in fluid communication with said fluid chamber means through said single opening and having a free edge;

a dosing device mounted in said neck means, said dosing device comprising:

an upper transverse wall at a distance from said free edge of said neck means, said transverse wall defining an air chamber and having an aperture therethrough, said aperture defining an evacuation hole in said air chamber;

a return fixed at a distance from said free edge of said neck means and having an opening defining discharge hole means for discharging the treatment fluid, said discharge hole means being axially spaced from said evacuation hole;

a skirt connected between said upper transverse wall and said return;

passage means along said skirt for conducting the treatment fluid between said evacuation hole means and said discharge hole means;

a casing having an upper extremity and an exterior and comprising a transverse partition at said upper extremity and a lateral partition extending downwardly from said transverse partition, said casing being positioned in said passage means; and an axially movable valve needle cooperating with said discharge hole means, said valve needle being mounted for axial sliding movement in said casing to open and close said discharge hole means in response to the level of said mass of water in said toilet tank whereby an air mass is trapped in said air chamber and expelled through said evacuation hole when said water level rises and treatment fluid is discharged into said discharge hole means when said water level falls;

said transverse wall, said return, and said skirt defining an inner sleeve coaxial with and mounted in said neck means.

6. The container of claim 5, said casing further comprising a plurality of projection means attached to said lateral partition and point towards said exterior for forcibly pushing said casing in place in said skirt and for maintaining radial and axial separations between said lateral partition and said skirt, said passage being defined by said separatations.

* * * * *